US006427246B1

(12) United States Patent
Doi et al.

(10) Patent No.: US 6,427,246 B1
(45) Date of Patent: Aug. 6, 2002

(54) GLOVE FOR BASEBALL

(75) Inventors: Tamotsu Doi; Toshiaki Nishimura; Kazuhiro Kume, all of Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 09/857,969

(22) PCT Filed: Oct. 12, 1999

(86) PCT No.: PCT/JP99/05625

§ 371 (c)(1),
(2), (4) Date: Jun. 8, 2001

(87) PCT Pub. No.: WO01/26754

PCT Pub. Date: Apr. 19, 2001

(51) Int. Cl.[7] ..... A41D 19/00
(52) U.S. Cl. ..... 2/161.1; 2/20; 2/159
(58) Field of Search ..... 2/16, 19, 20, 159, 2/160, 161.1, 161.2, 161.3, 161.4, 161.6; 273/26 C; 473/205, 300, 451, 458, 464, 206; 128/878, 879; 602/21, 22; 482/44, 47

(56) References Cited

U.S. PATENT DOCUMENTS

| | | | | |
|---|---|---|---|---|
| 4,461,043 A | | 7/1984 | Lomedico | 2/21 |
| 4,894,866 A | * | 1/1990 | Walker | 2/159 |
| 5,069,454 A | | 12/1991 | Frost | 273/165 |
| 5,168,578 A | * | 12/1992 | Stanley | 2/19 |
| 5,180,165 A | | 1/1993 | Frost | 273/165 |
| 5,604,934 A | | 2/1997 | Willett | 2/161.1 |
| 6,146,319 A | | 11/2000 | Tarail | 482/139 |
| 6,154,882 A | * | 12/2000 | Ullman | 2/20 |

FOREIGN PATENT DOCUMENTS

| | | |
|---|---|---|
| JP | 58-140122 | 9/1983 |
| JP | 63-176477 | 11/1988 |
| JP | 4-95077 | 8/1992 |
| SE | WO 96/24410 | 8/1996 |

* cited by examiner

*Primary Examiner*—Danny Worrell
*Assistant Examiner*—Gary L. Welch
(74) *Attorney, Agent, or Firm*—Troutman Sanders LLP; Gerald R. Boss; Ryan A. Schneider

(57) ABSTRACT

The inventive glove comprises a thumb holder (11), an index finger holder (12), a palm portion (14) and a back portion (15). A protective member (2) is mounted on a base portion (13) between the thumb holder (11) and the index finger holder (12). The protective member (2) includes a bent portion (21) extending from the base portion (13) toward the palm portion (14) and bent along the base portion (13) and a flat portion (22) extending from the base portion (13) toward the back portion (15), and has a substantially L-shaped section.

11 Claims, 8 Drawing Sheets

CONVENTIONAL EXAMPLE 2

GLOVE FOR BASEBALL

This patent application claims priority to International Application No. PCT/JP99/05625 having an international filing date of Oct. 12, 1999 entitled "Glove for Baseball." This International Application was not published in English.

TECHNICAL FIELD

The present invention relates to a glove employed for playing baseball, particularly for batting, and more specifically, it relates to a glove capable of enabling the wearer to firmly grip a bat and protecting the wearer's hand against a shock in batting.

BACKGROUND ART

In recent years, a baseball player generally grips a bat and wears a baseball glove or mitt not with a bare hand but with a glove.

This is in order to prevent slipping between the hand and the bat and improve fittingness between the bat and the hand when the baseball player grips the bat. Similarly, the baseball player employs the glove also when wearing the baseball glove or mitt in order to improve fittingness between the baseball glove or mitt and his hand.

In such a glove, elastic cloth may be applied to a required part of a back portion for making the back portion expandable so that the wearer can readily grip a bat.

Further, a leather pad may be applied to a palm portion of the glove for reinforcing the body of the glove while enabling the wearer to firmly grip a bat and relaxing a shock in batting.

However, a conventional glove is still insufficient in consideration of fittingness between the glove and a bat and protection of the wearer's hand against a shock in batting.

For example, U.S. Pat. No. 5,604,934 discloses a baseball glove having a gap member stuck to a palm portion thereof in order to fill up a gap defined between the glove and the grip of a bat when the wearer of the glove holds the grip of the bat.

However, the gap member is merely stuck to the palm portion of the baseball glove and the shape of the gap member, the position for sticking the gap member etc. are left out of consideration in this glove, which is still insufficient in fittingness and shock absorbability.

Japanese Utility Model Laying-Open No. 63-176477 discloses a grip-reforming golf glove formed by sticking or sewing an engager of a different material between a thumb holder and an index finger holder. This golf glove, invented on the basis of such an idea that the thumb and the index finger of a golfer are preferably in close contact with each other on the swing, is provided with a V-shaped engager between the thumb holder and the index finger holder in order to prevent the thumb and the index finger from separating from each other.

With such a structure, therefore, the wearer cannot grip a baseball bat and no shock absorbing function can be expected in batting.

U.S. Pat. No. 4,461,043 or U.S. Pat. No. 5,069,454 discloses not a glove for baseball but an invention for absorbing a shock in batting and protecting the hand of the wearer.

U.S. Pat. No. 4,461,043 describes an auxiliary member consisting of a cushion member of foamed plastic for receiving the thumb of the wearer in batting. In other words, this auxiliary member is located on the base between the thumb and the index finger of the wearer in batting for receiving the grip of a bat on the auxiliary member and absorbing a shock in batting.

In this invention, however, the auxiliary member rotates about the thumb and hence the wearer must rearrange the auxiliary member on the base between the thumb and the index finger every time he re-grips the bat. Further, the auxiliary member is so small that the same is sometimes dropped and lost during a baseball game.

U.S. Pat. No. 5,069,454 describes an auxiliary member more improved in fittingness between the hand of the wearer and the grip of a bat as compared with U.S. Pat. No. 4,461,043, while the wearer must arrange this auxiliary member on the base between the thumb and the index finger of his hand every time he re-grips the bat and the auxiliary member may be dropped and lost during a baseball game.

Accordingly, an object of the present invention is to provide a glove of more effectively filling up a gap defined between the glove and the grip of a baseball bat when the wearer grips the baseball bat as compared with the prior art, enabling the wearer to readily grip the bat and improving fittingness between the hand of the wearer and the bat.

Another object of the present invention is to provide a baseball glove capable of absorbing a shock caused by a ball colliding with a bat in batting and protecting the hand of the wearer.

DISCLOSURE OF THE INVENTION

The glove for baseball according to the present invention comprises a thumb holder or stall (11), an index finger holder or stall (12), a palm portion (14) and a back portion (15). A protective member (2) is mounted on or attached to a base or stump portion (13) between the thumb holder (11) and the index finger holder (12). The protective member (2) includes a bent portion (21) extending from the base portion (13) toward the palm portion (14) and bent along the base portion (13) and a flat or a plate-like portion (22) extending from the base portion (13) toward the back portion (15) and has a substantially L-shaped section.

According to the present invention, the protective member (2) is mounted on the base portion (13) between the thumb holder (11) and the index finger holder (12) and the protective member (2) is shaped in the aforementioned manner, whereby the glove (1) and the grip of a baseball bat (7) tightly fit with each other when the wearer holds the grip of the baseball bat (7) with the inventive glove (1).

The wearer hardly feels misfitness with respect to the protective member (2) when inserting his hand into the glove (1) or holding the grip of the baseball bat with the glove (1).

Further, a shock applied to the hand of the wearer in hitting can be absorbed by properly selecting the thickness of the protective member (2) and the material employed therefor.

The thickness of the protective member (2) is preferably largest at a central portion (25) of the bent portion (21) on a position corresponding to a corner (27) of the L-shaped section and reduced toward a peripheral portion (28).

Thus, the aforementioned fittingness can be improved by increasing the thickness of the protective member (2) at the central portion (25) of the bent portion (21).

The protective member (2) extends from a portion on the base of the thumb holder (11) to a portion on the base of the index finger holder (12).

Thus, fittingness between the baseball glove (1) and the grip of the baseball bat (7) can be further improved.

The central portion (25) of the bent portion (21) in a direction along the base portion (13) preferably has a shape along the outer periphery of the grip of the baseball bat (7).

Thus, the grip of the baseball bat (7) can be received in the central portion of the protective member (2). This can also effectively contribute to improvement of the aforementioned fittingness.

The central portion (25) of the bent portion (21) in the direction along the base portion (13) preferably has a radius of curvature substantially identical to the outer diameter of the grip of the baseball bat (7), and the radius of curvature of the bent portion (21) preferably increases toward an end (26) of the bent portion (21) in the direction along the base portion (13).

When the bent portion (21) is thus shaped to spread toward the forward ends of the thumb holder (11) and the index finger holder (12), not only the grip of the baseball bat (7) can be readily received but also the wearer can readily insert his hand into the glove (1). When the thickness of the end (26) is reduced, further, the wearer can hold the grip of the baseball bat (7) with small power.

The protective member (2) has a corner (27) on the base portion (13), the corner (27) is bent along the base portion (13), and the thickness of the corner (27) is lager than the thickness of the peripheral portion (28) of the protective member (2).

When the thickness of the corner (27) of the protective member (2) is thus increased, a shock applied to the hand of the wearer in hitting can be absorbed and the hand can be protected. The aforementioned corner (27) indicates a bent portion, and the surface thereof may be rounded as shown in FIG. 4 or the like, for example.

A leather pad may be sewn to cover the surface of the protective member (2).

Thus, the protective member (2) can be inhibited from coming off from the glove (1).

A shock absorbing member (4) may be held between the protective member (2) and the body of the glove.

Thus, a shock applied to the hand of the wearer in hitting can be further absorbed.

The glove (1) is mainly prepared from artificial leather or natural a leather, with employment of elastic cloth at need. The protective member a (2) is sewn on or/and stuck to the glove (1).

Thus, the protective member (2) is sewn on or/and stuck to the glove (1) according to the present invention, whereby an auxiliary member is not lost in the middle of a baseball game dissimilarly to U.S. Pat. No. 4,461,043 or U.S. Pat. No. 5,069,454.

In batting, the wearer may not rearrange any auxiliary member on the base between the thumb and the index finger every time he re-holds the grip of the baseball bat (7).

The glove (1) according to the present invention does not inhibit motion of the hand of the wearer not only in batting but also in fielding.

In other words, the wearer can smoothly insert his hand into a baseball glove or mitt in the state wearing the glove (1) since the shape of the protective member (2) matches with the shape of the base between the thumb and the index finger of the wearer. When the wearer closes the baseball glove or mitt, the protective member (2) is bent similarly to the action of holding the grip of the baseball bat (7), not to stretch and inhibit the wearer from closing the baseball glove or mitt.

DETAILED DESCRIPTION

Figure 1:
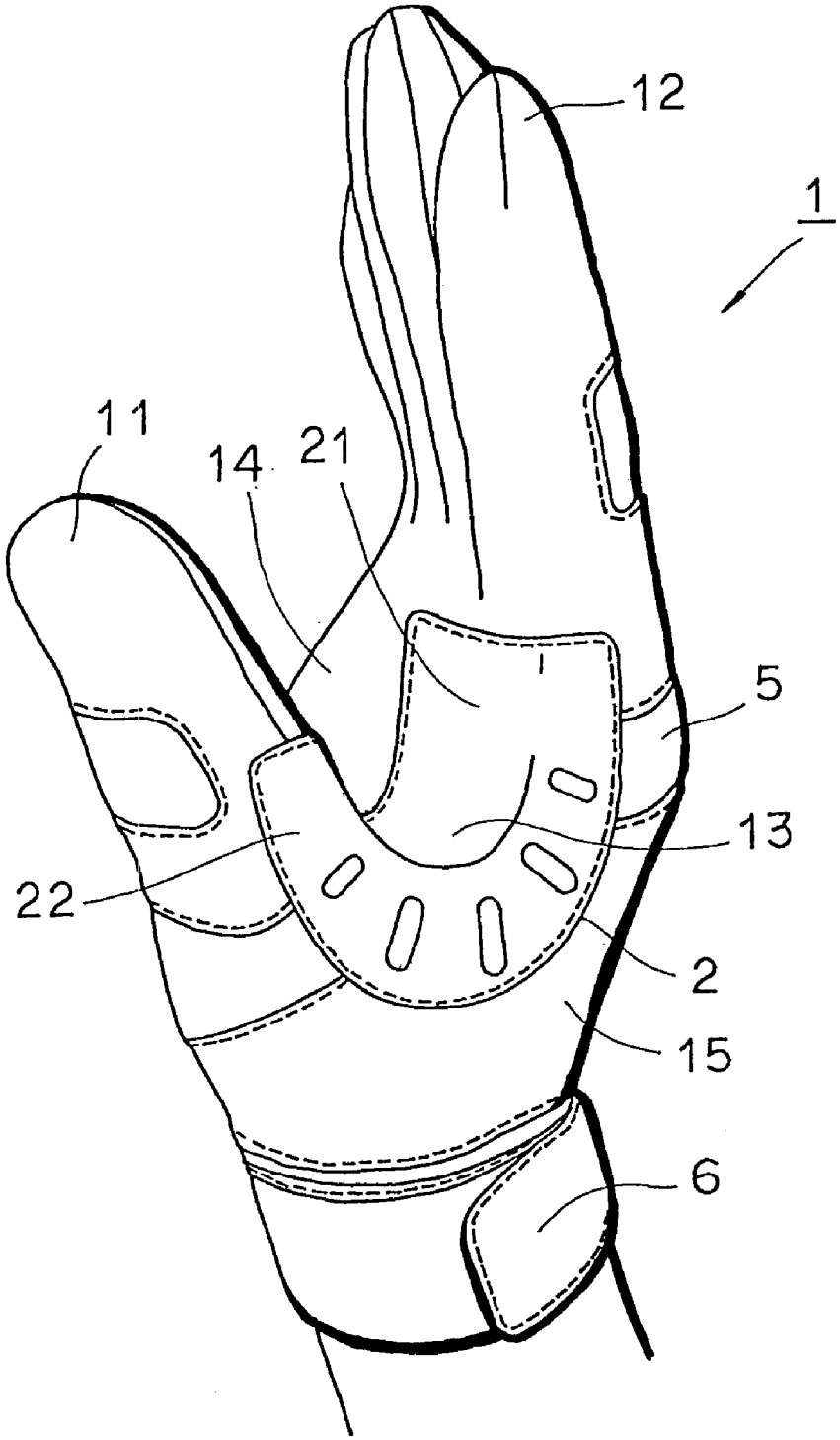
FIG. 1 is a perspective view of a glove according to an embodiment of the present invention.
Figure 2:
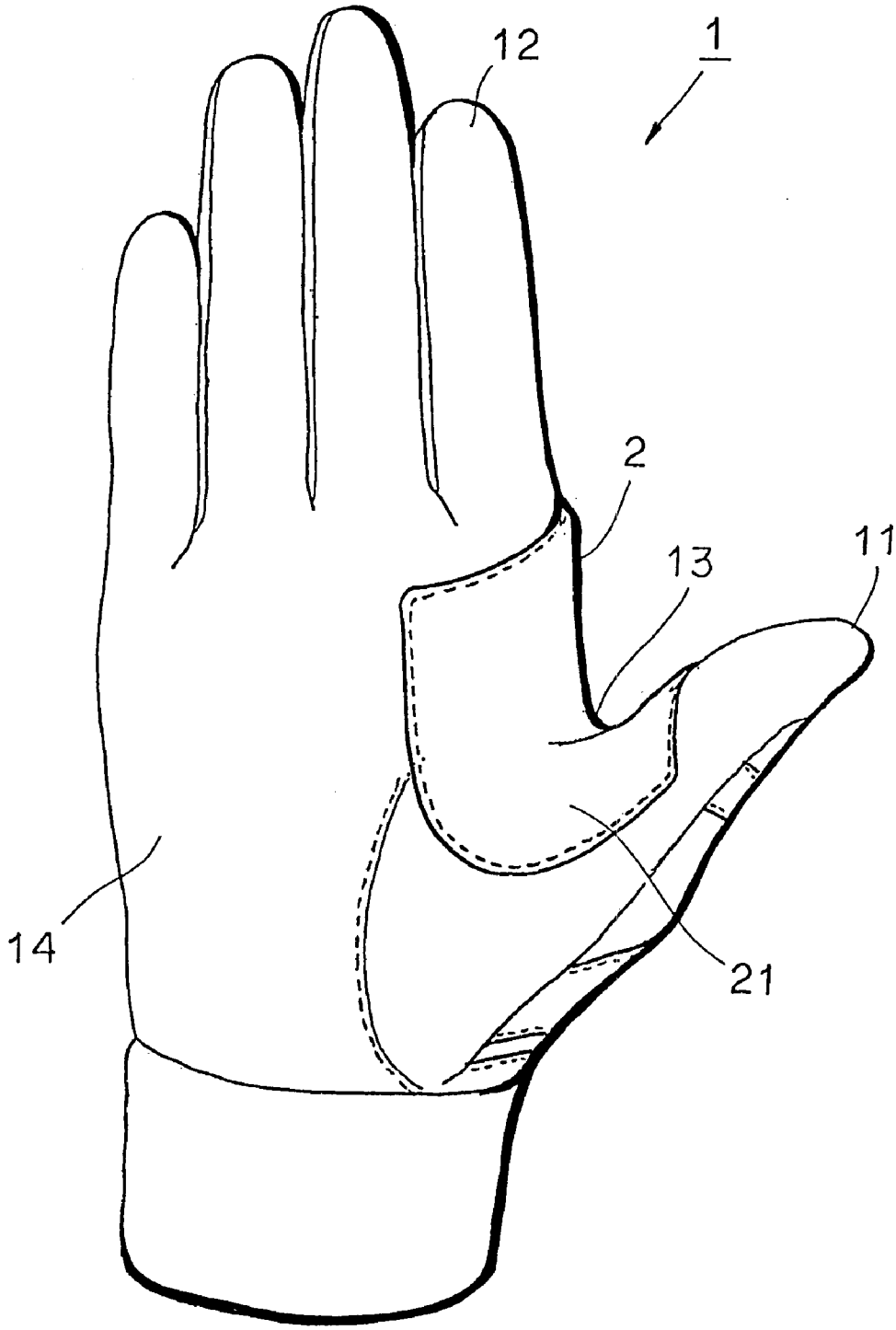
FIG. 2 illustrates the glove shown in FIG. 1 as viewed from a palm portion.
Figure 3:
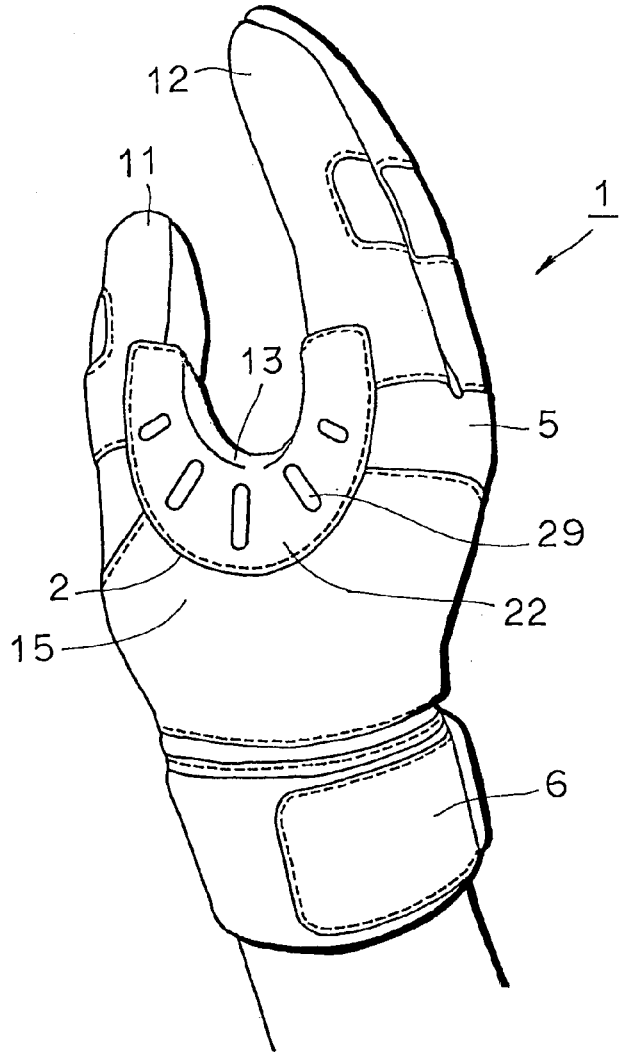
FIG. 3 illustrates the glove shown in FIG. 1 as viewed from a direction reaching the side surface of an index finger holder from the side surface of a thumb holder.
Figure 4:
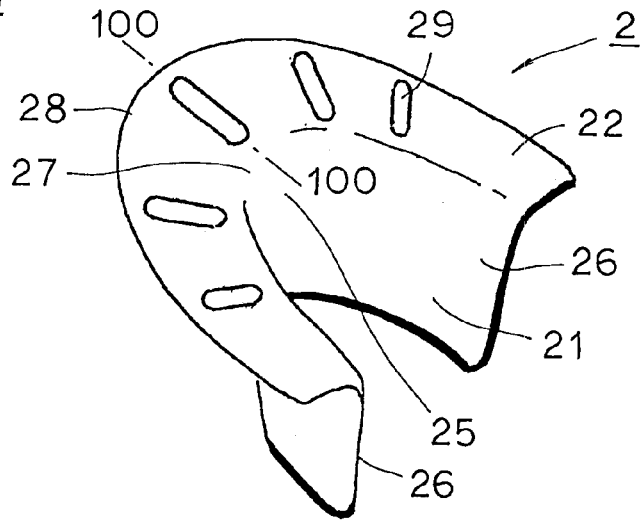
FIG. 4 is a perspective view of a protective member.

FIG. 1 illustrates a glove (for the right hand) 1 for baseball according to the present invention as viewed obliquely from above a base or stump portion 13 between a thumb holder or stall 11 and an index finger holder or stall 12, FIG. 2 illustrates the glove 1 as viewed from the side of a palm portion 14, and FIG. 3 illustrates the glove 1 as viewed from a direction reaching the side surface of the index finger holder 12, from the side surface of the thumb holder 11. FIG. 4 is a perspective view of a protective member 2 sewn on or/and stuck to the glove 1, and FIG. 5 is an end view taken along the line 100—100 in FIG. 4.

The glove 1 according to the present invention is mainly prepared from artificial leather or natural leather with employment of elastic cloth at need, similarly to a conventional glove.

As shown in FIGS. 1 to 3, the protective member 2 is sewn on or/and stuck to the base portion 13 between the thumb holder 11 and the index finger holder 12.

Figure 5:
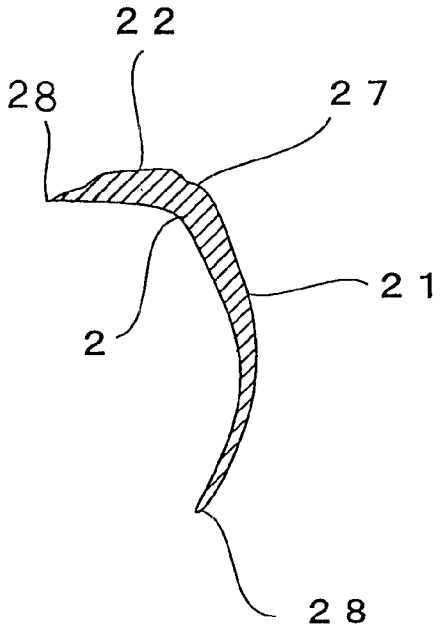
FIG. 5 is an end view taken along the line 100—100 in FIG. 4.

The protective member 2 has a bent portion 21 and a flat or plate-like portion 22, as shown in FIGS. 4 and 5. The bent portion 21 extends from the base portion 13 onto the palm portion 14 as shown in FIG. 2, and the flat portion 22 extends from the base portion 13 onto the back portion 15 as shown in FIG. 3. In the mode shown in FIGS. 4 and 5, the flat portion 22 extends in a direction substantially orthogonal to the bent portion 21, so that the protective member 2 has a substantially L-shaped section. The angle at which the flat portion 22 and the bent portion 21 intersect with each other is properly changeable.

The bent portion 21 is sewn on or/and stuck to the palm portion 14 of the glove 1, as shown in FIG. 2.

Figure 8:
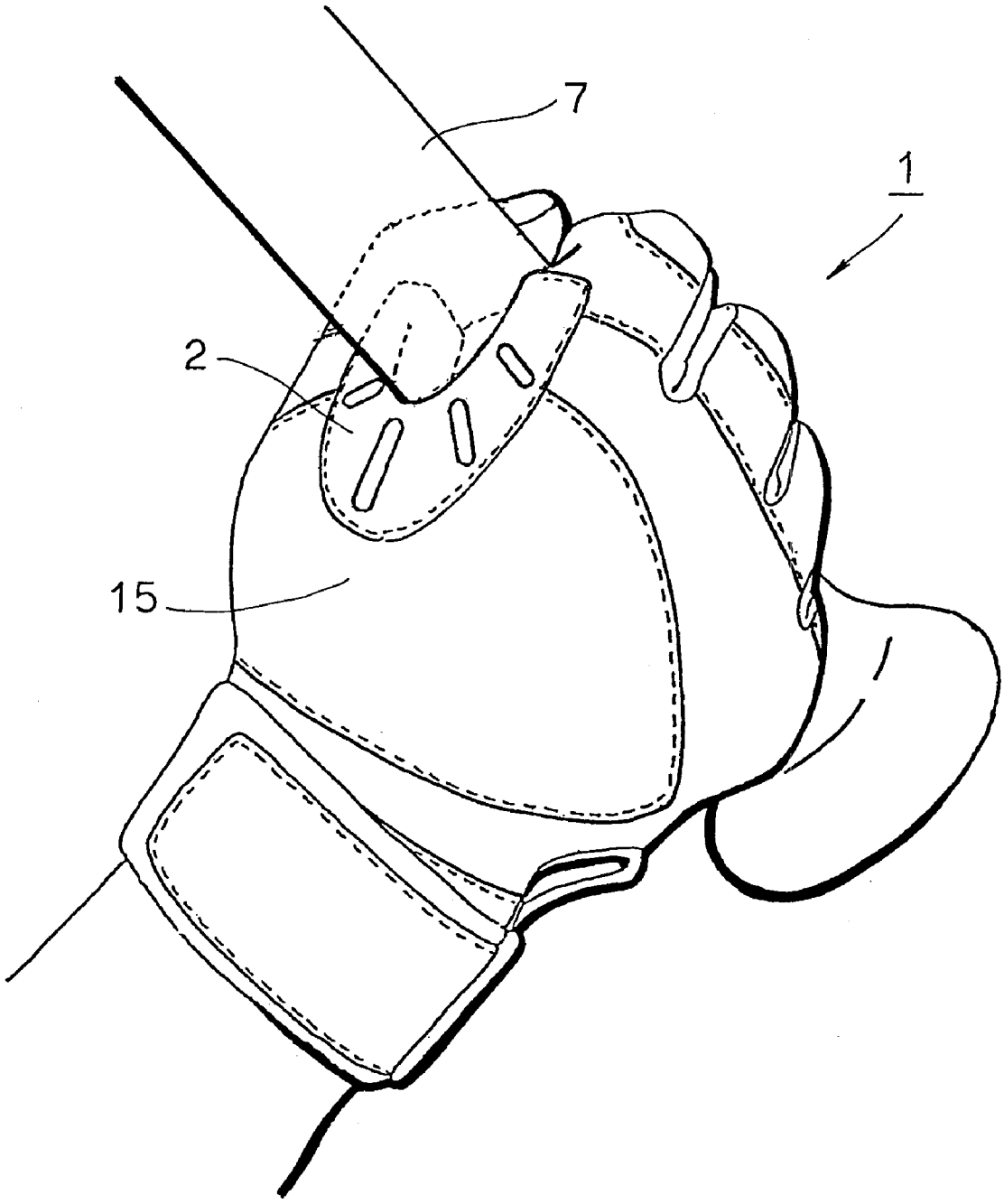
FIG. 8 is a perspective view showing the hand of the wearer of the inventive baseball glove holding the grip of a baseball bat.

When the wearer of the glove 1 grips a baseball bat 7 as shown in FIG. 8, the grip of the bat 7 directly comes into contact with this portion.

The bent portion 21 is actuate along the base portion 13 as viewed from the direction reaching the side surface of the index finger holder 12 from the side surface of the thumb holder 11, as shown in FIG. 3. In other words, the bent portion 21 is bent in the direction (the direction along the base portion 13) from the base of the thumb holder 11 toward the base of the index finger holder 12 in a prescribed curvature.

Further, a central portion 25 of the bent portion 21 in the direction along the base portion 13 has a shape along the outer periphery of the grip of the baseball bat 7. More specifically, the central portion 25 has a radius of curvature substantially identical to the outer diameter of the grip of the baseball bat 7, and the radius of curvature of the bent portion 21 is increased from the central portion 25 toward ends 26 shown in FIG. 4.

Thus, the grip of the baseball bat 7 fits into the central portion 25 of the bent portion 21 of the protective member 2.

When the wearer of the glove 1 according to the present invention just softly holds the grip of the baseball bat 7, therefore, a gap between the baseball glove 1 and the baseball bat 7 is filled up to improve fittingness.

The radius of curvature of the bent portion 21 is increased toward the ends 26 as described above, and hence the distance between the thumb holder 11 and the index finger, holder 12 is increased toward the ends 26. Therefore, the ends 26 do not hinder the bent portion 21 from receiving the grip of the baseball bat 7.

This shape is also preferable for the wearer for inserting his hand into the baseball glove 1.

In other words, the shape of the protective member 2 matches with the shape of the base between the thumb and the index finger of the wearer, and hence the wearer can smoothly insert his hand into the glove 1.

Further, the bent portion 21 is slightly actuate also in the sectional direction (the direction from the base portion 13 toward the central portion of the palm portion 14) thereof, as shown in FIG. 5.

Thus, the bent portion 21 is along the palm surface of the hand of the wearer, and fittingness between the glove 1 and the grip of the baseball bat 7 is further improved due to this shape.

The thickness of the protective member 2 is largest at the central portion 25 of the bent portion 21 on a position corresponding to a corner (bent portion) 27 of the L-shaped section, and reduced toward a peripheral portion 28.

When the wearer holds the grip of the baseball bat 7, the gap between the glove 1 and the grip can be most efficiently filled up due to the aforementioned shape.

The protective member 2 efficiently relieves the hand of the wearer from transmission of a shock applied in batting. In particular, the shock applied in batting can be efficiently relaxed by increasing the thickness of the corner 27 as shown in FIG. 5. The corner 27 arcuately extends along the base portion 13, to be capable of absorbing shocks applied from many directions.

The flat portion 22 of the protective member 2 extends on the side surface of the thumb holder 11 and on the side surface of the index finger holder 12, and has a substantially flat surface. In the embodiment shown in FIG. 4, ribs 29 are selectively formed on this surface.

The flat portion 22 absorbs the shock in batting along with the bent portion 21. The flat portion 11 extending in a direction subjected to the batting pressure can exhibit resistance against the batting pressure for absorbing the batting pressure.

The flat portion 22 can attain higher resistance due to the ribs 29 provided on the surface thereof Further, the flat portion 22 extending on the side surface of the base of the thumb holder 11 and on the side surface of the base of the index finger holder 12 can also protect the bases of the thumb and the index finger of the wearer.

The shape of the flat portion 22 is arbitrarily changeable so far as the same extends in the direction subjected to the batting pressure. The shape and the number of the ribs 29 are also properly changeable.

The protective member 2 can be formed by polyethylene, thermoplastic urethane elastomer, polyester elastomer, polyamide elastomer, TPE elastomer or the like.

The hardness of the protective member 2 is suitably 30–80 and more preferably 40–50 as measured using a Shore A durmeter.

When the peripheral portion 28 of the protective member 2 is reduced in thickness, this portion can be readily set on a sewing machine when the same is sewn onto the glove 1. Thus, sewing can be readily performed.

When the peripheral portion 28 of the protective member 2 is reduced in thickness, further, the wearer is enabled to grasp the grip of the baseball bat 7 with small power.

Figure 6:
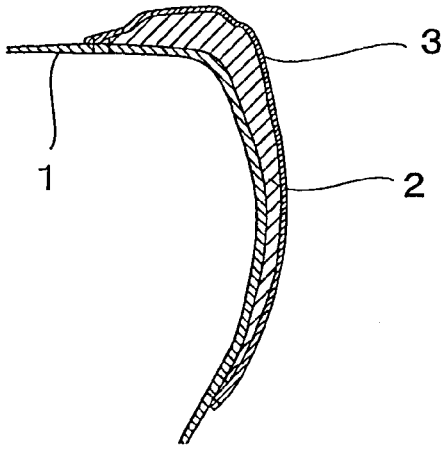
FIG. 6 is an end view of another embodiment of the present invention cut along the same position as that in FIG. 5.

As shown in FIG. 6, the surface of the protective member 2 is preferably covered with a leather pad 3. This leather pad 3 is sewn on the glove 1.

On the sewn portion between the glove 1 and the protective member 2, artificial leather or natural leather may be torn due to pressure applied by repetitive batting.

When the protective member 2 is covered with the leather pad 3, however, the artificial leather or the natural leather can be inhibited from being torn due to the pressure applied by repetitive batting.

Figure 7:
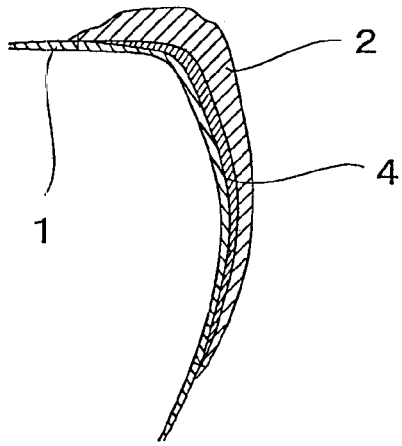
FIG. 7 is an end view of still another embodiment of the present invention cut along the same position as that in FIG. 5.

As shown in FIG. 7, a shock absorbing member 4 can be held between the protective member 2 and the body of the glove 1. Thus, the shock in batting can be further absorbed.

The shock absorbing member 4 can be prepared from rubber sponge, EVA sponge, polyethylene foam, polyurethane foam, acrylic foam, a member prepared by impregnating polyurethane foam or acrylic foam with asphalt, silicon bouncing putty or polybutadiene, silicon bouncing putty or the like.

In addition, an elastic material 5 may be applied to a desired position of the glove 1 or a tightening strap 6 may be provided on a wrist portion in an arbitrary manner, similarly to the conventional glove.

Results of a comparative experiment made by the inventor for confirming effects attained from the glove 1 according to the present invention are now described.

A glove scan system by Nitta Kabushiki Kaisha was utilized for directly applying a pressure sensor to the hand of a subject, making the subject to swing the baseball bat 7 toward a rubber tee and measuring impact pressure against the hand of the subject. The impact pressure was measured as to each of a case of using a conventional glove prior art 1), a case of wearing the pad described in U.S. Pat. No. 4461043 along with the conventional glove (prior art 2) and a case of using the glove 1 according to the present invention. The subject was a right-handed batter, and the sensor was applied to the right hand of the subject.

Figure 9:
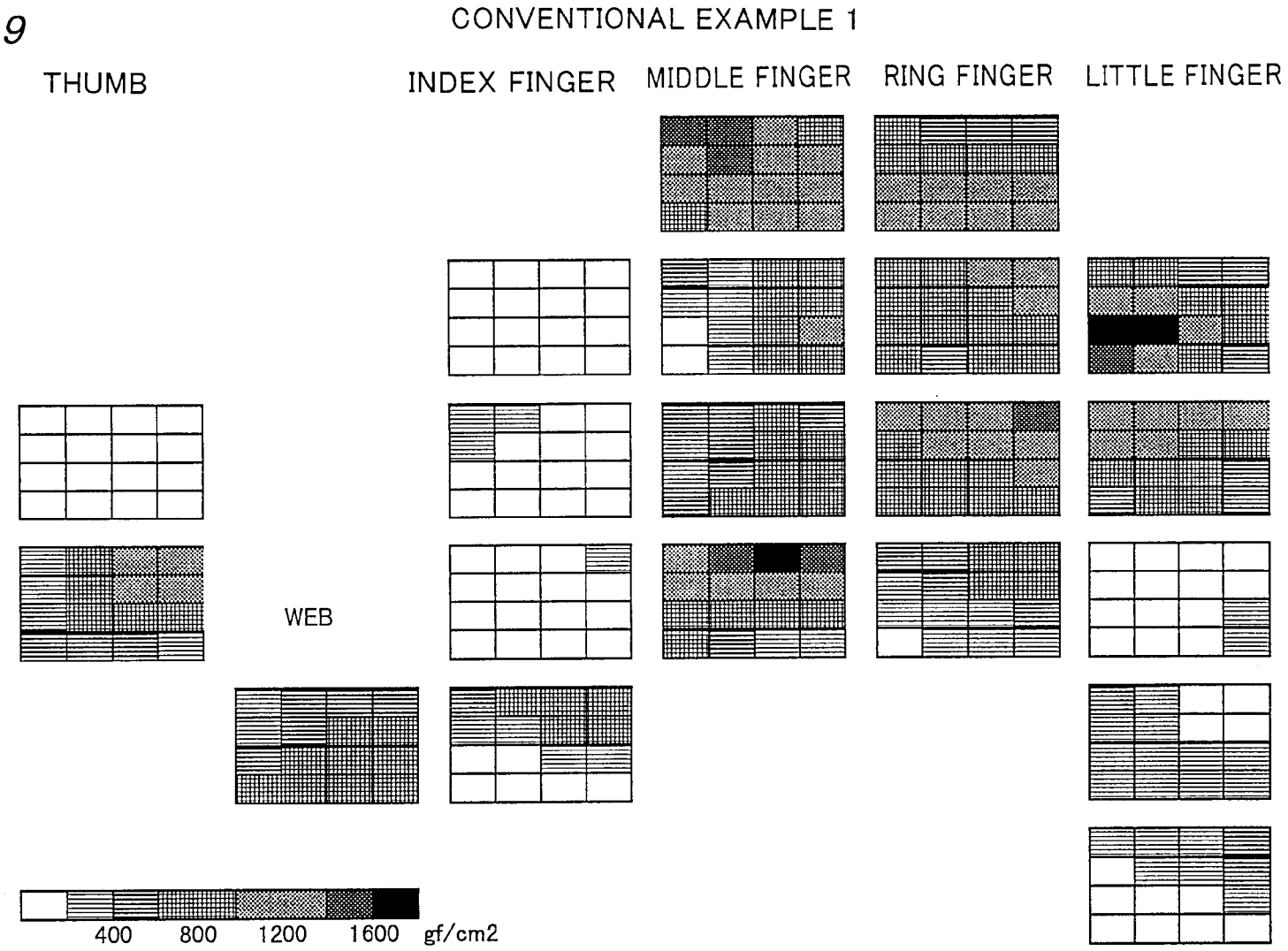
FIG. 9 shows results of an experiment made on a conventional baseball glove.
Figure 10:
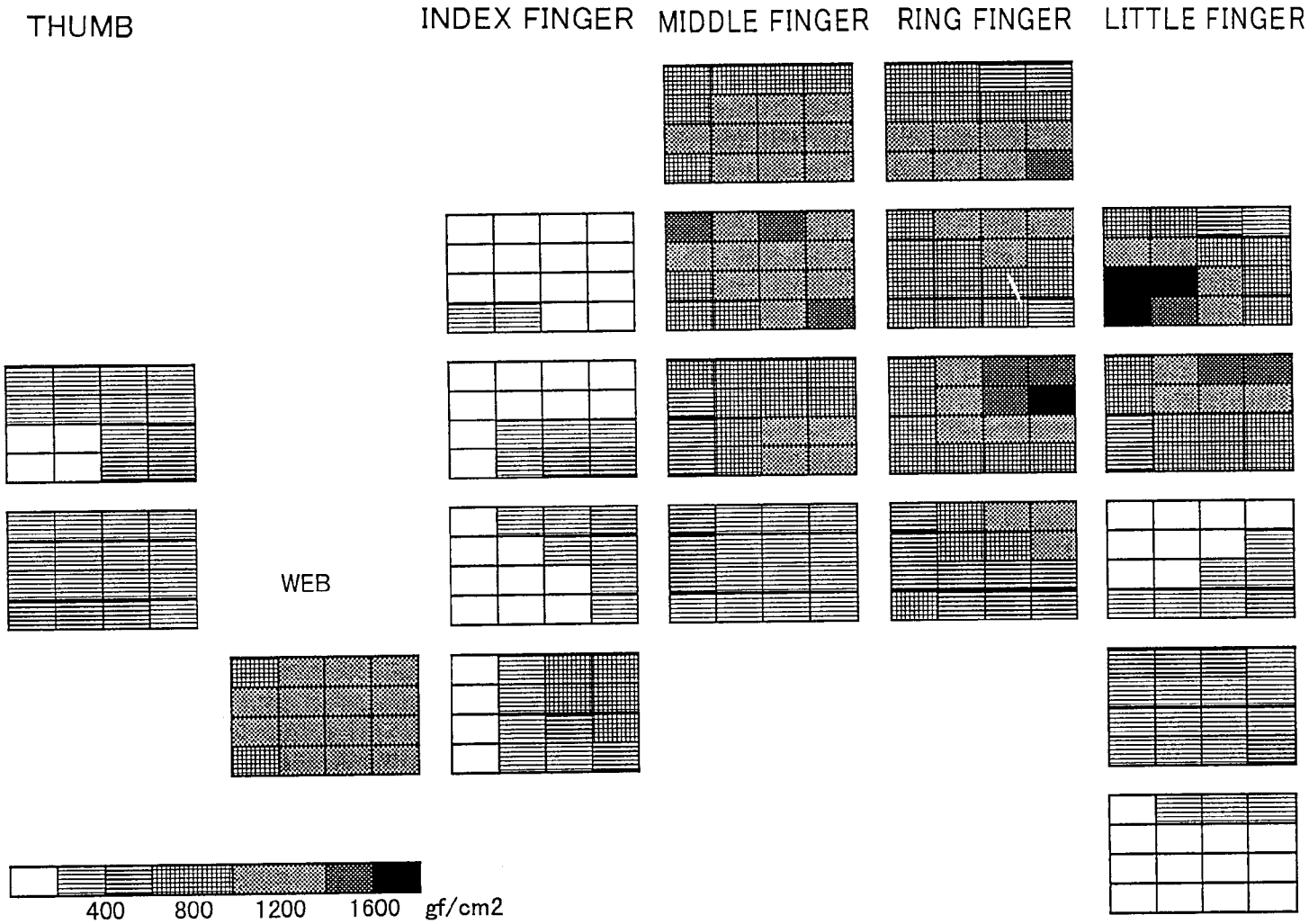
FIG. 10 shows results of an experiment made on the conventional baseball glove and a conventional pad.
Figure 11:
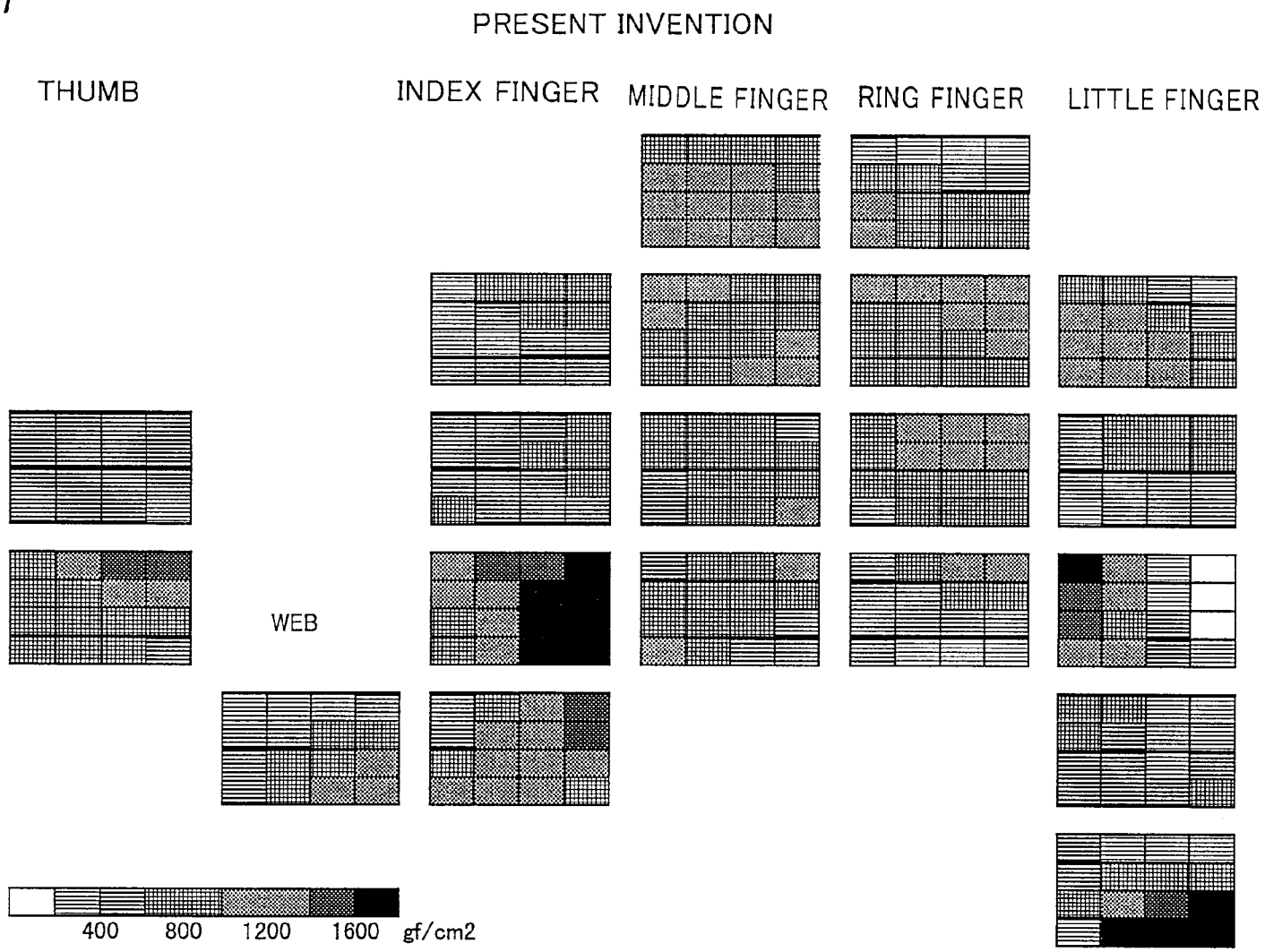
FIG. 11 shows results of an experiment made on the inventive baseball glove.

FIGS. 9 to 11 shows the respective results of the aforementioned experiment. It is understood from FIGS. 9 and 10 that the pressure on the base (WEB part) of the thumb is increased when the subject wears the pad along with the conventional glove. This means that the WEB part comes into close contact with the baseball bat 7 when the subject wears the pad, to readily transmit the power of the hand to the baseball bat 7.

On the other hand, it is understood from FIG. 11 that pressure is increased not only on the aforementioned WEB part but also on the side surfaces of the thumb and the index finger when the subject wears the glove 1 according to the present invention. Thus, it is inferred that the hand of the wearer of the glove 1 according to the present invention can be brought into close contact with the baseball bat 7 along the thumb and the index finger through the glove 1. When the wearer grips the baseball bat 7 with the glove 1 according to the present invention, therefore, fittingness with the gripped baseball bat 7 is so improved that the power of the hand can be reliably transmitted to the baseball bat 7.

While the embodiments of the present invention have been described, the embodiments disclosed this time are illustrative in all points and not restrictive. The scope of the present invention is shown by the scope of claim for patent, and all modifications are included within the meaning and range equivalent to the scope of claim for patent.

Industrial Applicability

The present invention is effectively applicable to a glove used in batting.

What is claimed is:

1. A glove for baseball comprising a thumb holder, an index finger holder, a palm portion and a back portion, wherein:

a semi-rigid protective member is camed by a base poron between said thumb and said index finger holder;

said semi-rigid protective member includes a bent portion extending from said base portion toward said palm portion and bent along said base portion and a flat portion extending from said base portion toward said back portion and has a substantially L-shaped section;

said bent portion being arcuate in the direction from said base portion toward a central portion of said palm portion; and said flat portion includes at least one rib extending therefrom.

2. The glove according to claim 1, wherein the thickness of said semi-rigid protective member is largest at a central portion of said bent portion on a position corresponding to a corner of said L-shaped section and reduced toward a peripheral portion.

3. The glove according to claim 1, wherein said semi-rigid protective member extends from a portion on the base of said thumb holder to a portion on the base of said index finger holder.

4. The glove according to claim 1, wherein a central portion of said bent portion in a direction along said base portion has a shape corresponding to an outer periphery of a grip of a baseball bat.

5. The glove according to claim 1, wherein a central portion of said bent portion in a direction along said base portion has a radius of curvature substantially identical to an outer diameter of a grip of a baseball bat; and the radius of curvature of said bent portion increases toward an end of said bent portion in a direction along said base portion.

6. The glove according to claim 1, wherein said semi-rigid protective member has a cornher on said base portion, said corner is bent along said base portion, and said corner is thicker than a peripheral portion of said semi-rigid protective member.

7. The glove according to claim 1, wherein a leather pad is sewn to cover a surface of said semi-rigid protective member.

8. The glove according to claim 1, wherein a shock absorbing member is held between said semi-rigid protective member and a base portion of said glove.

9. The glove according to claim 1, wherein said semi-rigid protective member has a hardness between 40 and 50 as measured using a Shore A hardness scale.

10. The glove according to claim 1, wherein said semi-rigid protective member has a hardness between 30 and 80 as measured using a Shore A hardness scale.

11. The glove according to claim 1, wherein said semi-rigid protective member comprises a material selected from the group consisting of: polyethylene, thermoplastic urethane elastomer, polyester elastomer, and TPE elastomer.

* * * * *